United States Patent [19]

Zitzmann

[11] 3,983,661

[45] Oct. 5, 1976

[54] GEARING FOR THE LOCOMOTION OF TOY FIGURES

[76] Inventor: Hans Zitzmann, D 8632 Neustadt near Coburg, Germany

[22] Filed: May 12, 1975

[21] Appl. No.: 576,352

[30] Foreign Application Priority Data

May 16, 1974 Germany ..... 2423903

[52] U.S. Cl. ..... 46/132

[51] Int. Cl.² ..... A63H 11/04

[58] Field of Search ..... 46/123

[56] References Cited

UNITED STATES PATENTS 1,462,092 7/1923 Lindstrom ..... 46/132

*Primary Examiner*—Louis G. Mancene
*Assistant Examiner*—Robert F. Cutting
*Attorney, Agent, or Firm*—Gottlieb, Rackman, Reisman & Kirsch

[57] ABSTRACT

In a gearing for the locomotion of toy figures between two end positions the gearing is formed as string drive with two string wheels mounted on a common shaft pivoted in bearing in the body of the toy figure and respective one string belonging to each string wheel, which string is mounted with the one end at the belonging string wheel and can be gripped with the other end, both strings being partly windable on the belonging string wheels and are tensionable in a direction opposite to one another and whereby furthermore in the end positions of the toy figure the one string respectively is wound up onto the string wheel belonging to it, the other string thereagainst is wound off.

1 Claim, 8 Drawing Figures

GEARING FOR THE LOCOMOTION OF TOY FIGURES

Figure 1:
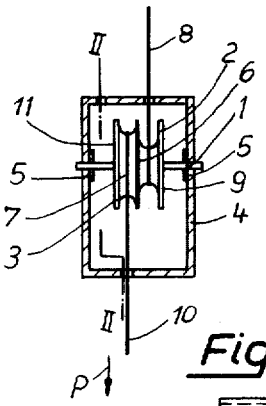

The invention relates to a gearing for the locomotion of toy figures between two end positions. It is based upon the object to provide a gearing to be actuated manually which gearing is designated for the locomotion of toy figures and if necessary the locomotion of further figure parts, is low in production costs and leads to a high play stimulation.

The desired aim is obtained in a gearing for the locomotion of toy figures between two end positions according to the invention in that the gearing is formed as string drive with two string wheels mounted on a common shaft pivoted in bearing in the body of the toy figure and respective one string belonging to each string wheel, which string is mounted with the one end at the belonging string wheel and can be gripped with the other end, both strings being partly windable on the belonging string wheels and are tensionable in a direction opposite to one another and whereby furthermore in the end positions of the toy figure the one string respectively is wound up onto the string wheel belonging to it, the other string thereagainst is wound off. Advantageously the shaft of the string wheels is designed as crankshaft for the drive of movable toy figure parts.

If the gearing is to be used for example for climbing figures, e.g. a climbing monkey with movable arms, then it is recommended to make the construction so that, a further crankshaft is arranged to the string wheel-crankshaft and is drivable from the first mentioned crankshaft and this further crankshaft is pivoted in the body of the toy figure and is cranked with the free ends in the direction of the arms and is firmly connected with these arms.

On utilization of the gearing according to the invention for climbing figures it is moreover advisable to calculate the dead weight of the same so that its downwards motion occurs automatically.

If in such a climbing figure the free ends of both the oppositely directed strings are gripped and a tension is applied on the string directed downwardly then it results in that the both string wheels are brought to rotational motion such that the figure moves upwardly, the lower string being wound off and the upper string being wound up. If the climbing figure is in its upper end position and will then the lower string be released, so the climbing figure — conditional on its dead weight— moves downwardly into its lower end position.

During the upwards and downwards motion the arms are reciprocated by the crank drive so that the impression of a climbing occurs. This impression can still be enhanced that the hands on the one side, the feet on the other side are brought together and that the string leading upwardly is led through between the hands especially between a loop provided there, the string leading downwardly thereagainst between the feet, particularly a loop provided there.

Figure 2:
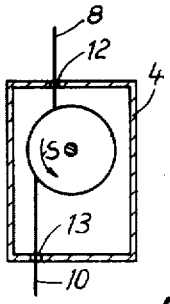
Figure 3:
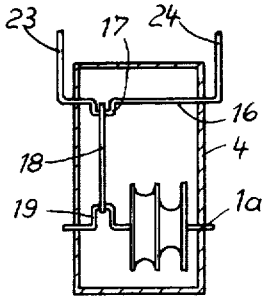
Figure 4:
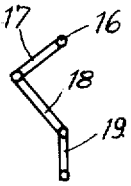
Figure 5:
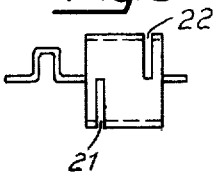
Figure 6:
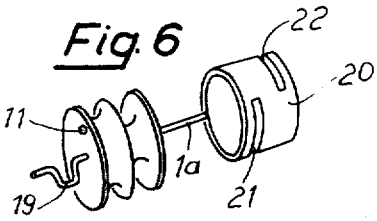
Figure 7:
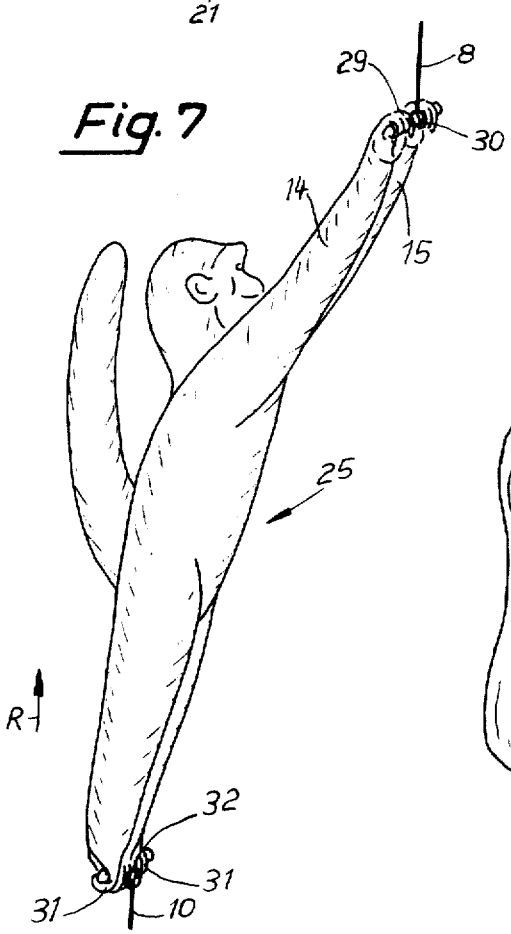
Figure 8:
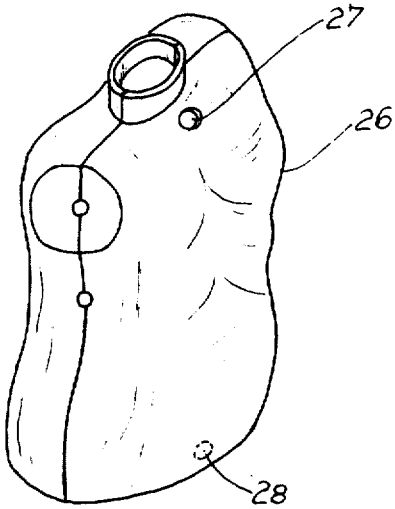

Further advantages and features of the invention are explained in the following description of the drawing, which illustrates one embodiment. There are shown:

FIG. 1 the gearing with removed upper part of the housing,

FIG. 2 a section along the line II—II in FIG. 1,

FIG. 3 a representation corresponding to FIG. 1 of a string drive extended by a crank drive, FIG. 4 a representation from which the position of the crank members can be seen from the side, FIG. 5 the string wheels with their crankshaft and a string guiding tube, FIG. 6 the parts shown in FIG. 5 drawn apart and schematically, FIG. 7 schematically a climbing monkey, FIG. 8 the body of the climbing monkey according to FIG. 7, schematically enlarged.

On the shaft 1 the both string wheels 2 and 3 are mounted. The shaft 1 is pivoted in bearing in the housing 4. It is secured against axial displacement by the discs 5. The diameter of the core 6 of the string wheel 2 is considerably smaller than the diameter of the core 7 of the string wheel 3. The string 8 can be wound up and wound off of the string wheel 2. The string 8 is with its one end mounted at 9 on the string wheel 2. A string belongs to the string wheel 3 in an analogous manner; this string is designated with 10. The one end of which is mounted at 11 on the string wheel 3. The string 8 is led through an opening 12 and the string 10 is led through an opening 13 in the housing 4. Supposing the strings 8 and 10 would have a length of about 1 m and the string 10 would be wound so long onto the string wheel 3 that only a short piece projects the opening 13 outwardly. If then the string 8 is held at the free end and a tensile force in the direction of the arrow P is applied on the free end of the string 10, then this effects that the both string wheels rotate in the sense of the arrow S (FIG. 2) the string 10 being wound off and the string 8 being wound up. In that the string 8 is wound up, the housing 4 moves upwardly. If hereupon the free end of the string 10 is released, i.e. no tensile force is more applied on the string 10, then the dead weight of the housing 4 and its gearing effect that the housing moves upwardly, the string 8 being wound off and the string 10 being wound.

In the embodiment according to FIG. 3 the string gear has been so extended that it can serve as a drive e.g. the arms 14 and 15 of the climbing figure shown in FIG. 7. The shaft 1 is here formed as crankshaft 1*a* and furthermore another crankshaft designated with 16 is parallel thereto mounted in bearings in the housing 4, the crank 17 of which is connected with the crank 19 of the crankshaft 1*a* through the connecting rod 18. As to warrant that the strings 8 and 10 always run into the belonging string wheels, an appropriate cylindrical tube 20 is loosely pushed on over the string wheels 2 and 3 in which tube guiding slots 21, 22 for guiding the strings are provided.

The free ends 23, 24 of the crankshaft 16 are so cranked that they on utilization for a climbing figure, e.g. the climbing monkey shown in FIG. 7, project into the arms 14, 15 of said monkey. The free ends 23, 24 are firmly connected with the arms 14 and 15, so that on upward movement and on downward movement of the climbing figure 25 the arms 14, 15 carry out a reciprocating swinging movement which is equal to the movement of the arms on climbing.

In the climbing figure 25 the gearing housing is formed of the body 26 consisting e.g. of synthetic material in which the shaft 1*a* and the crankshaft 16 are mounted in bearings. This body is formed in two parts and has on the front portion the openings 27 and 28 through which the strings 8 and 10 with their free ends are led outwardly.

In the climbing figure 25 the hands 29 are led together and furthermore a loop 30 is here provided through which the string 8 runs which comes from the opening 27. The feet 31 are led together in an analogous manner; also here a loop is arranged which is designated with 32 and through which the string 10 is led which comes from the opening 28.

By holding fast of the free ends of the strings 8 and 10 and applying a tensile force to one of the strings it is obtained that the climbing figure 25 climbs upwardly in direction of the arrow R. On releasing of the string 10 thereagainst the figure 25 climbs downwardly. The gear can be used for each kind of movement in upward or downward direction in that the part to be moved obtains such a weight that it on releasing moves through the dead weight along the string downwardly.

The gear can if necessary also be used for the locomotion of a structural member in the plane, the movement in the one direction being obtained by application of a tensile force on the one end of the string and the movement in the other direction being obtained by back motion of the structural member by hand.

What is claimed is:

1. A drive mechanism for a climbing toy comprising a housing, a first crankshaft, means for mounting said first crankshaft for rotation within said housing, said mounting means preventing axial displacement of said first crankshaft relative to said housing, a second crankshaft, means for mounting said second crankshaft for rotation within said housing, means for operatively connecting said first crankshaft to said second crankshaft such that rotation of said first crankshaft imparts rotation to said second crankshaft, a first string wheel having a first diameter and connected to said first crankshaft, a second string wheel having a second diameter smaller than said first diameter and connected to said first crankshaft, a first string connected to said first string wheel and adapted to be wound and unwound therefrom, a second string connected to said second string wheel and adapted to be wound and unwound therefrom, said first string and said second string connected to their respective string wheels such that when said first string is wound on said first string wheel said second string is unwound from said second string wheel and such that when said first string is unwound from said first string wheel said second string is wound on said second string wheel, a first aperture in said housing enabling said first string to pass from said first string wheel through said housing, a second aperture in said housing enabling said second string to pass from said second string wheel through said housing, and guide means disposed over said first string wheel and said second string wheel and rotatable therewith, said guide means defining a first slot for guiding said first string as said string is wound and unwound on said first string wheel and defining a second slot for guiding said second string as said string is wound and unwound on said second string wheel.

* * * * *